US006595019B1

(12) United States Patent
Millette et al.

(10) Patent No.: US 6,595,019 B1
(45) Date of Patent: Jul. 22, 2003

(54) MECHANICAL MEANS FOR DEFROSTING COLD PLATES

(75) Inventors: Jocelyn Millette, Shawinigan-Sud (CA); Pierre Archambault, Sherbrooke (CA); Jean Baribeault, St-Mathieu du Parc (CA)

(73) Assignee: Frygy Cube International Inc., Bromptonville (CA)

( * ) Notice: Subject to any disclaimer, the term of this patent is extended or adjusted under 35 U.S.C. 154(b) by 0 days.

(21) Appl. No.: 10/103,533

(22) Filed: Mar. 22, 2002

(51) Int. Cl.[7] ..... F25D 21/06; F25D 21/00
(52) U.S. Cl. ..... 62/284; 62/80; 165/94
(58) Field of Search ..... 62/284, 342, 80; 165/94

(56) References Cited

U.S. PATENT DOCUMENTS

| | | | | | |
|---|---|---|---|---|---|
| 851,516 | A | * | 4/1907 | Hickley | 174/14 R |
| 1,934,556 | A | * | 11/1933 | Pelz | 15/245 |
| 4,126,015 | A | * | 11/1978 | Fujie et al. | 62/284 |
| 4,417,541 | A | * | 11/1983 | Schafer | 118/326 |
| 4,570,447 | A | * | 2/1986 | Jonasson | 62/80 |
| 4,970,749 | A | * | 11/1990 | Priore | 15/236.02 |
| 5,086,534 | A | * | 2/1992 | Journee | 15/250.201 |
| 5,168,595 | A | * | 12/1992 | Naylor, Jr. | 15/250.4 |
| 5,325,561 | A | * | 7/1994 | Kotlar | 15/250.06 |
| 5,613,266 | A | * | 3/1997 | Lee | 15/250.201 |
| 6,032,323 | A | * | 3/2000 | Smith et al. | 15/250.003 |
| 6,282,742 | B1 | * | 9/2001 | Boggs | 15/236.02 |
| 6,343,402 | B1 | * | 2/2002 | Smith et al. | 15/250.3 |

FOREIGN PATENT DOCUMENTS

| | | | | | |
|---|---|---|---|---|---|
| DE | 29718826 | U1 | * | 2/1999 | B65D/81/18 |
| JP | 354123756 | A | * | 9/1979 | F25D/21/06 |
| JP | 405296645 | A | * | 11/1993 | 62/256 |
| WO | WO 00/49349 | | * | 8/2000 | F25D/16/00 |

* cited by examiner

*Primary Examiner*—William E. Tapolcai
*Assistant Examiner*—Mohammad M. Ali
(74) *Attorney, Agent, or Firm*—Eric Fincham

(57) ABSTRACT

The present invention relates to a mechanical means for defrosting plates used in cold storage. Frost reduces the transfer of heat to the plates and partially or totally obstructs the passage of air. Several methods are used to remove frost from plates: hot water, sprayed steam, hot gas, heating elements.

In the present invention, scrapers sweep the surface of the plates to remove the frost. This method allows to remove the frost while the plates are being discharged, which improves the performance of the plates and does not affect the residual charge of the plates.

The proposed defrosting system is made up of vertical scrapers located on either side of the plates. The upper and lower extremities of the scrapers are fastened to scraper supports. These supports move along tubular guide bars which are parallel to and located beneath and above the plates. To ensure that the movement of the upper and lower supports is uniform, an endless screw is installed parallel to and centered between the upper and lower guide bars. A pinion is mounted on one end of each endless screw. The pinions located at the end of each endless screw are linked to the pinion of the drive motor by a chain. Limit switches are provided to invert the movement of the scrapers.

7 Claims, 8 Drawing Sheets

MECHANICAL MEANS FOR DEFROSTING COLD PLATES

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER LISTING

Not Applicable

BACKGROUND OF THE INVENTION

1. Field of Invention

The present invention relates to a mechanical means for defrosting plates used in cold storage.

2. Description of Prior Art

Cold storage systems used in the transportation of refrigerated or frozen goods are made up of plates containing a phase change material (eutectic plates) and a system which produces cold. When the truck is idle, the cold is produced and stored in eutectic plates located in the cargo space of the truck. When the vehicle is on the road, cold is no longer produced and the cold stored in the eutectic plates is used.

In the text of this patent, the plates are said to be charged when the solution inside the plates is solid (low enthalpy) and discharged when the solution is in liquid form (high enthalpy). The plates are discharged by transferring the heat from the surrounding environment to the solution, whereby it melts. The plates are charged through a refrigeration system that withdraws the heat from the solution, whereby it becomes solid.

Typically, the plates are assembled in parallel and side by side and forced air circulates between them. The air circulating between the plates is the air produced in the truck's cargo space. This air is warmer than the surface of the plates in order to promote the transfer of heat and it is likely to have a dew point temperature that is higher than the temperature of the surface of the plates, which inevitably results in the formation of frost on the surface of the plates. Frost impairs the performance of the apparatus because it reduces the transfer of the heat of the air to the plates and partially or totally obstructs the passage of air.

In general, the defrosting of cold storage plates (eutectic plates) used in refrigerated trucks is performed through the following procedures:

Heating Elements: Electric heating elements are glued to the sides of the plates and melt the frost. The power required to rapidly defrost the plates is significant. In U.S. Pat. No. 5,172,567, heating elements are directly built into the plates.

Hot Water or Sprayed Steam: Hot water or steam is sprayed onto the frost to melt it. Pipes are permanently installed on the apparatus. The hot water and steam are provided through an external source. The water and melted frost fall into a container at the base of the apparatus.

Hot Gas: The surface of the plates is heated by using the refrigeration system's condensing unit. The refrigerant from the condenser is channeled through tubes which are in contact with the surface of the plates. When the refrigerant circulates through the tubes, at a high pressure and temperature, it heats the surface of the plates and melts the frost. This method is described in U.S. Pats. Nos. 4,043,144 and 4,110,997. These three methods encompass significant disadvantages, such as:

The defrosting process must be performed at the loading dock because a significant amount of energy is required either to start up the refrigerating unit, to produce the hot water and sprayed steam or to provide the electrical power for the heating elements.

Electric defrosting requires a substantial amount of power and soon becomes costly to operate.

Hot water and sprayed steam can, in certain cases, damage the shipment in the refrigerated truck. The truck must therefore be unloaded before starting the defrosting process. The water or the defrosting solution must be properly treated, destroyed or recycled.

In the three methods described above, part of the heat used to melt the frost seeps into the cargo space which results in an undesirable increase in the temperature of the refrigerated trailer.

By applying heat to the surface of the plates, these three methods promote the heating of the cold storage solution inside the plates and reduces the level of residual charge. Consequently, the time required to completely recharge the plates is much longer. This results in a significant waste of energy and time before the truck can be loaded.

SUMMARY OF THE INVENTION

The method proposed in this patent does not use any heat source to melt the frost. The frost is simply removed from the surface and falls into a container at the base of the plates. This container is emptied periodically. The frost is removed from the surface of the plates by scrapers that sweep the plates horizontally. The method described in this patent allows for defrosting to be performed while the plates are being discharged which improves the thermal performance of the cold storage system.

This defrosting system is used at temperatures which do not exceed the freezing point of water. As long as the surfaces to be defrosted remain below the freezing point, the density of the surface frost which is formed is low and the frost is friable. If the temperature of the surface or the accumulated frost becomes higher than the freezing point and subsequently becomes lower, ice will form and the scrapers will not perform properly. In such cases, the entire system should be brought to a temperature which is higher than the melting point of water in order to melt the ice and accumulated frost. Under normal circumstances, eutectic plates are charged during the night and discharged during the day. However, the amount of residual cold at the end of the discharging process is sufficient to maintain the temperature of the surface of the plates at a lower level than the temperature of the frost's melting point. It is therefore possible to effect several charging/discharging cycles without having to bring the surface of the plates to a higher temperature than that of the temperature of the frost's melting point. Conserving the residual cold at the end of the charging process results in a saving of time and energy for subsequent charging.

BRIEF DESCRIPTION OF THE DRAWINGS

The attached drawings show the detailed assembly of the scrapers and their mechanism which are designed for, built and installed on eutectic plates.

In relation to the drawings illustrating the preferred embodiment of the invention.

REFERENCES

1) Eutectic Plate
2) Frame
3) Scraper
4) Scraper Blade
5) Flexible Lip
6) Scraper Support
7) Tubular Guide Bar
8) Linear Bearing
9) Tubular Guide Bar and Endless Screw Support
10) Endless Screw
11) Ball Bearing
12) Endless Screw Pinion
13) Drive Chain
14) Drive Motor Pinion
15) Drive Motor
16) Limit Switch
17) Chain Adjuster
18) Nut
19) Diverting Sprocket-Wheel
20) Frost Container

DESCRIPTION OF THE PREFERRED EMBODIMENT OF THE INVENTION

Figure 1:
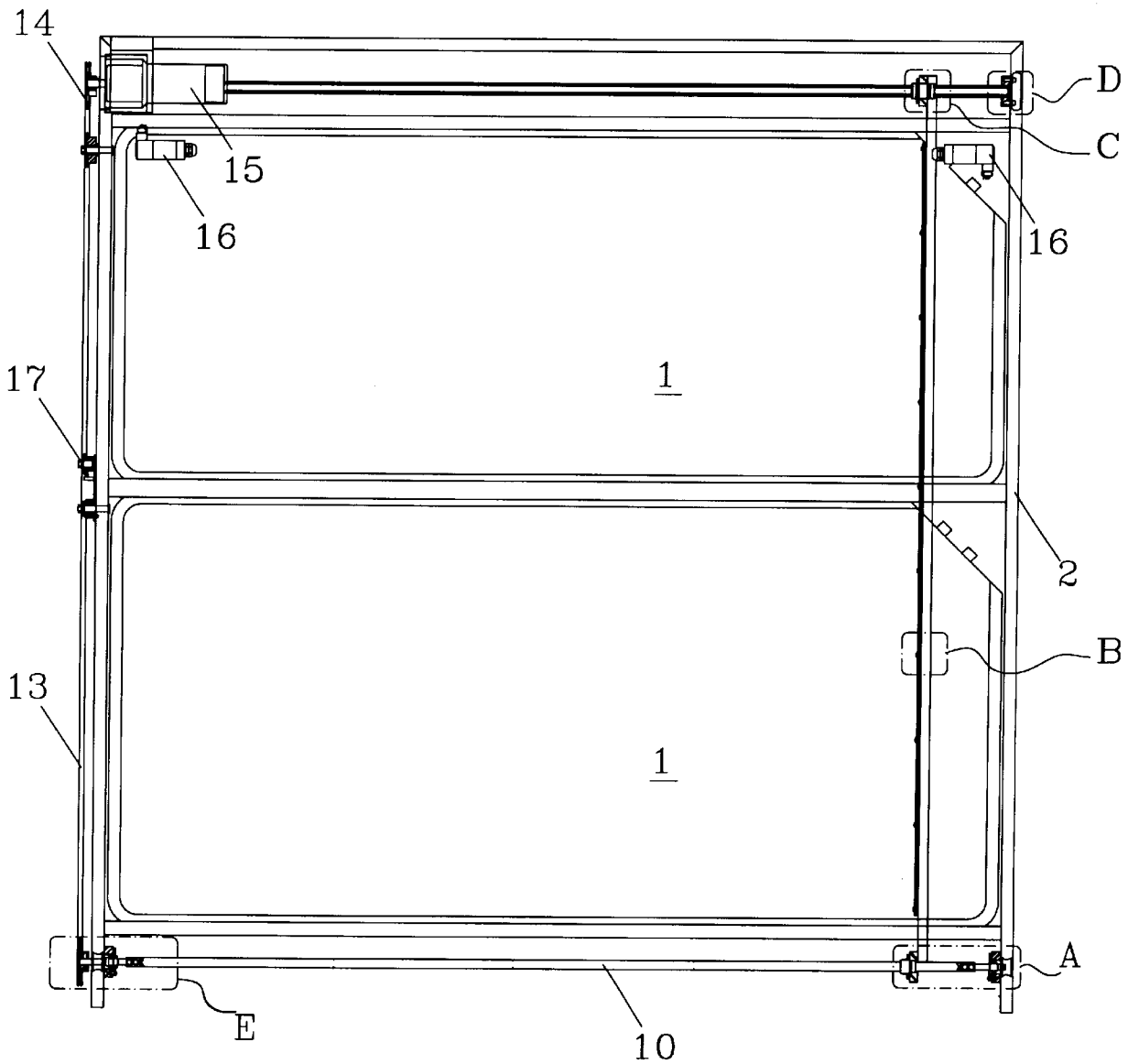
FIG. 1 represents a front elevation of the preferred embodiment
Figure 7:
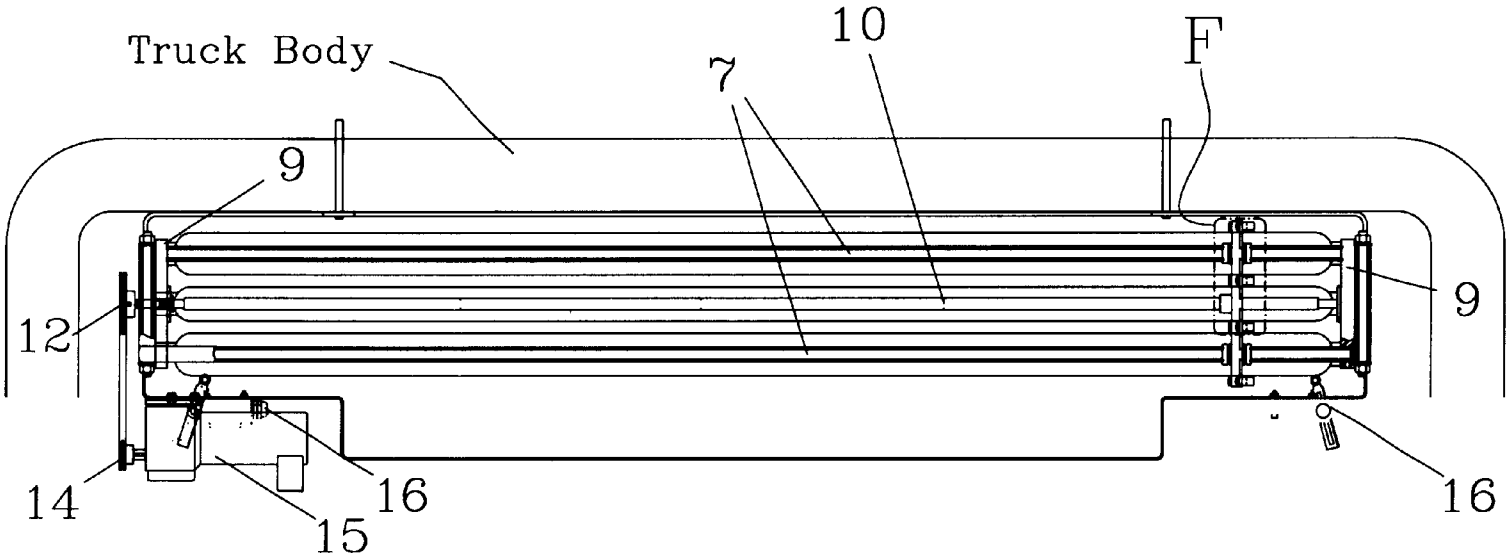
FIG. 7 represents a top view of the upper part of the preferred embodiment
Figure 8:
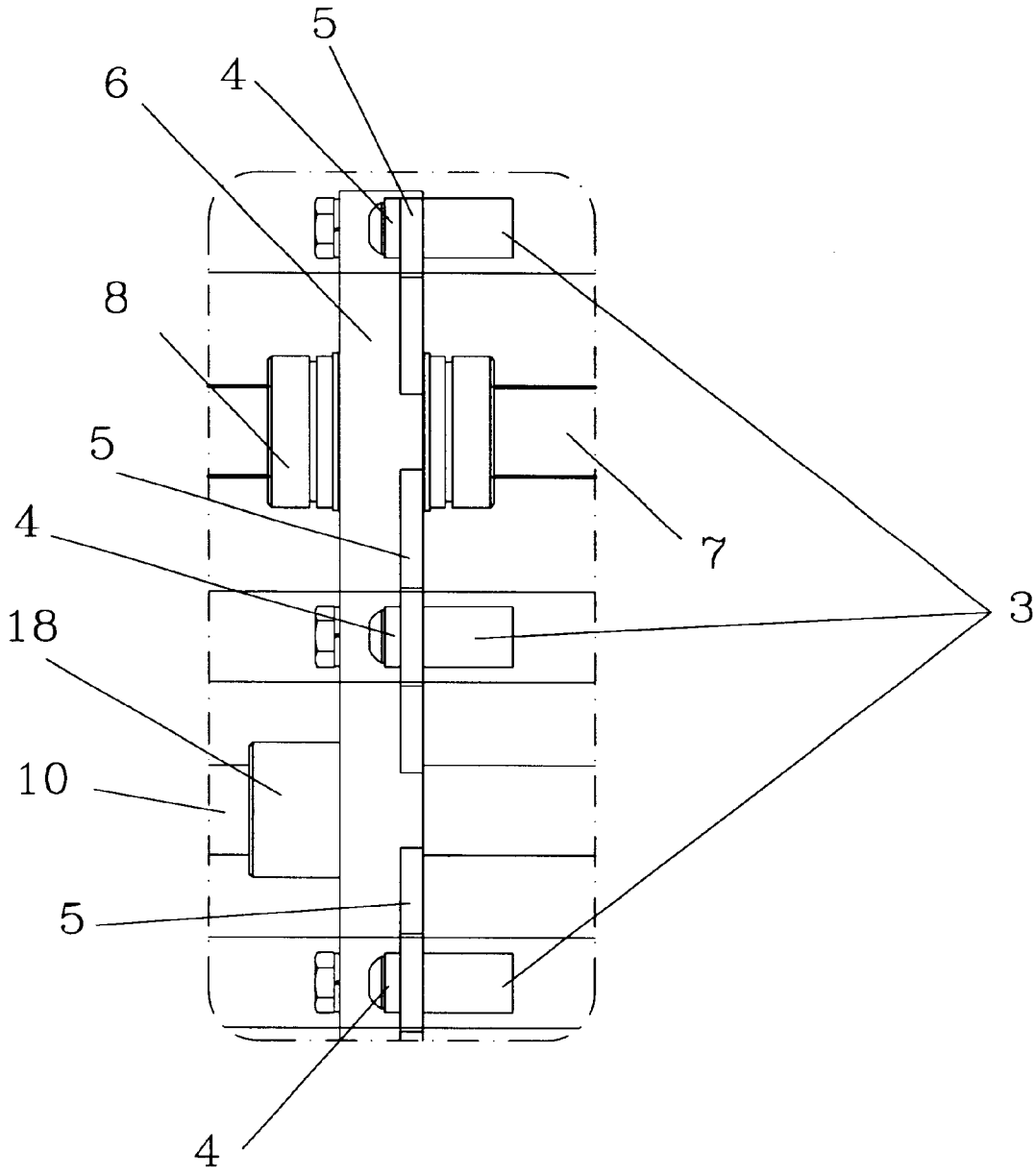
FIG. 8 is an enlargement of Part F of FIG. 7

In FIG. 1, the defrosting system is mounted on a set of 6 eutectic plates (1) held together by a frame (2). FIG. 7 shows that the plates (1) are grouped by two according to a parallel plan. FIG. 8 shows that the proposed defrosting system is made up of four vertical scrapers (3) located on either side of the pairs of eutectic plates (1). The scraper blades (4), which are bolted to the scrapers (3), and the scrapers (3) have flexible lips (5) between them. These flexible lips (5) allow for the surface to be scraped without it being damaged.

Figure 2:
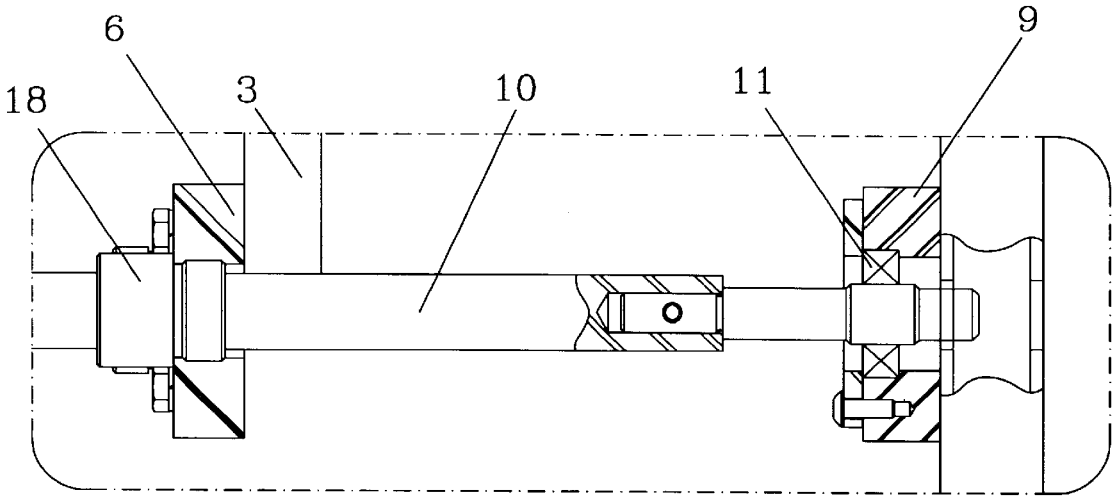
FIG. 2 is an enlargement of Part A of FIG. 1
Figure 3:
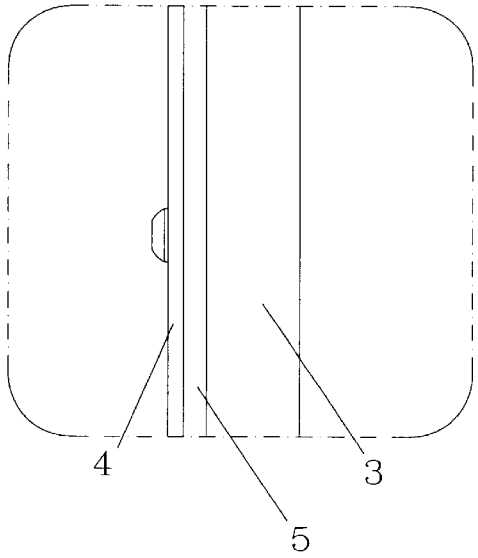
FIG. 3 is an enlargement of Part B of FIG. 1
Figure 4:
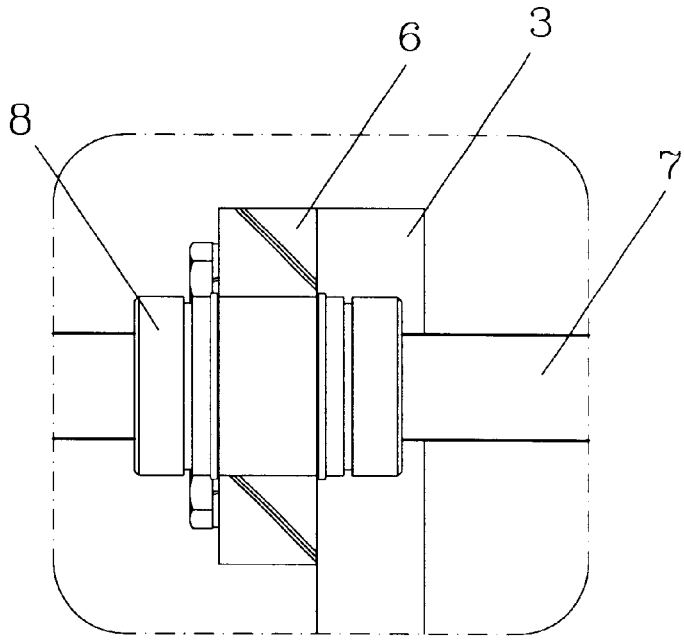
FIG. 4 is an enlargement of Part C of FIG. 1
Figure 5:
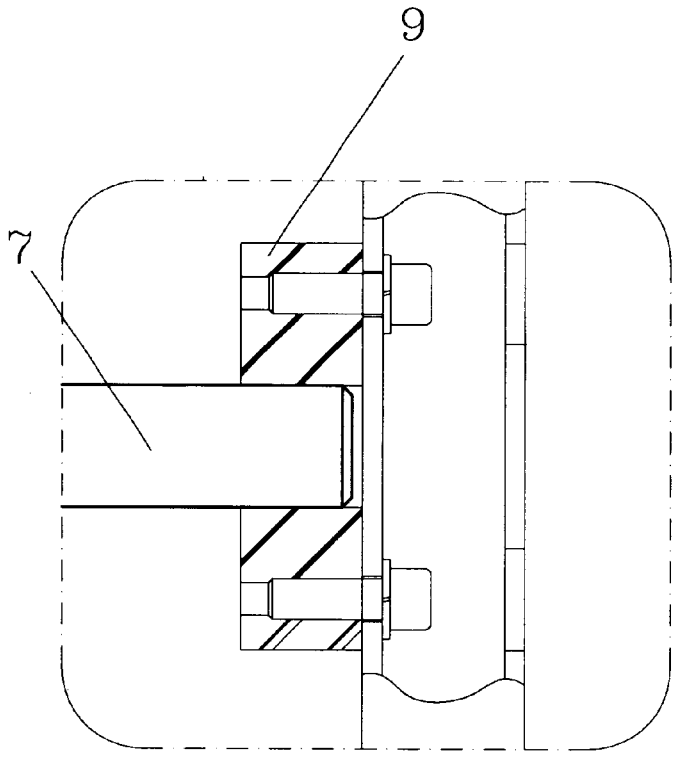
FIG. 5 is an enlargement of Part D of FIG. 1
Figure 6:
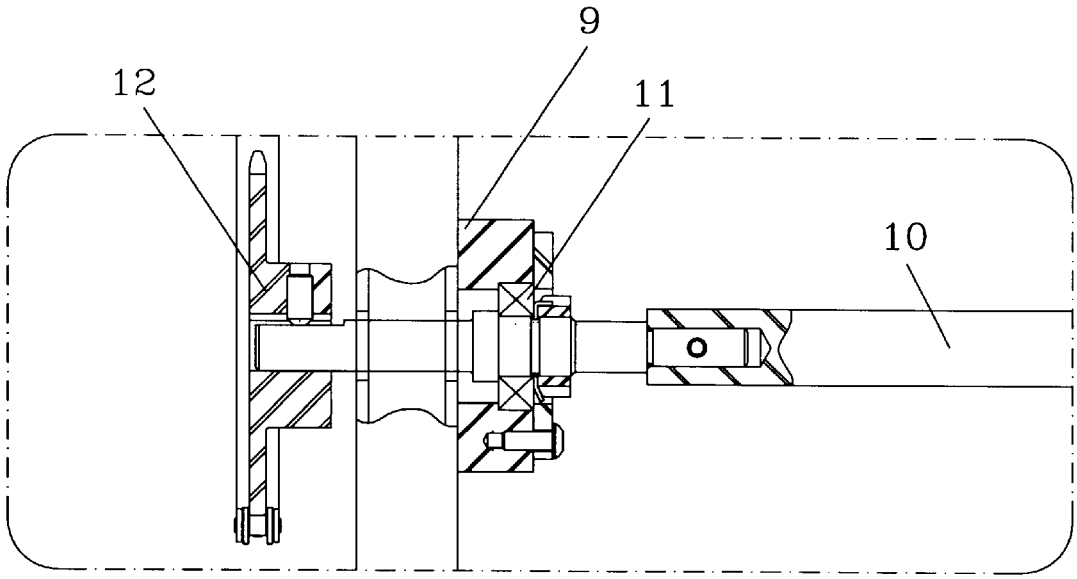
FIG. 6 is an enlargement of Part E of FIG. 1
Figure 9:
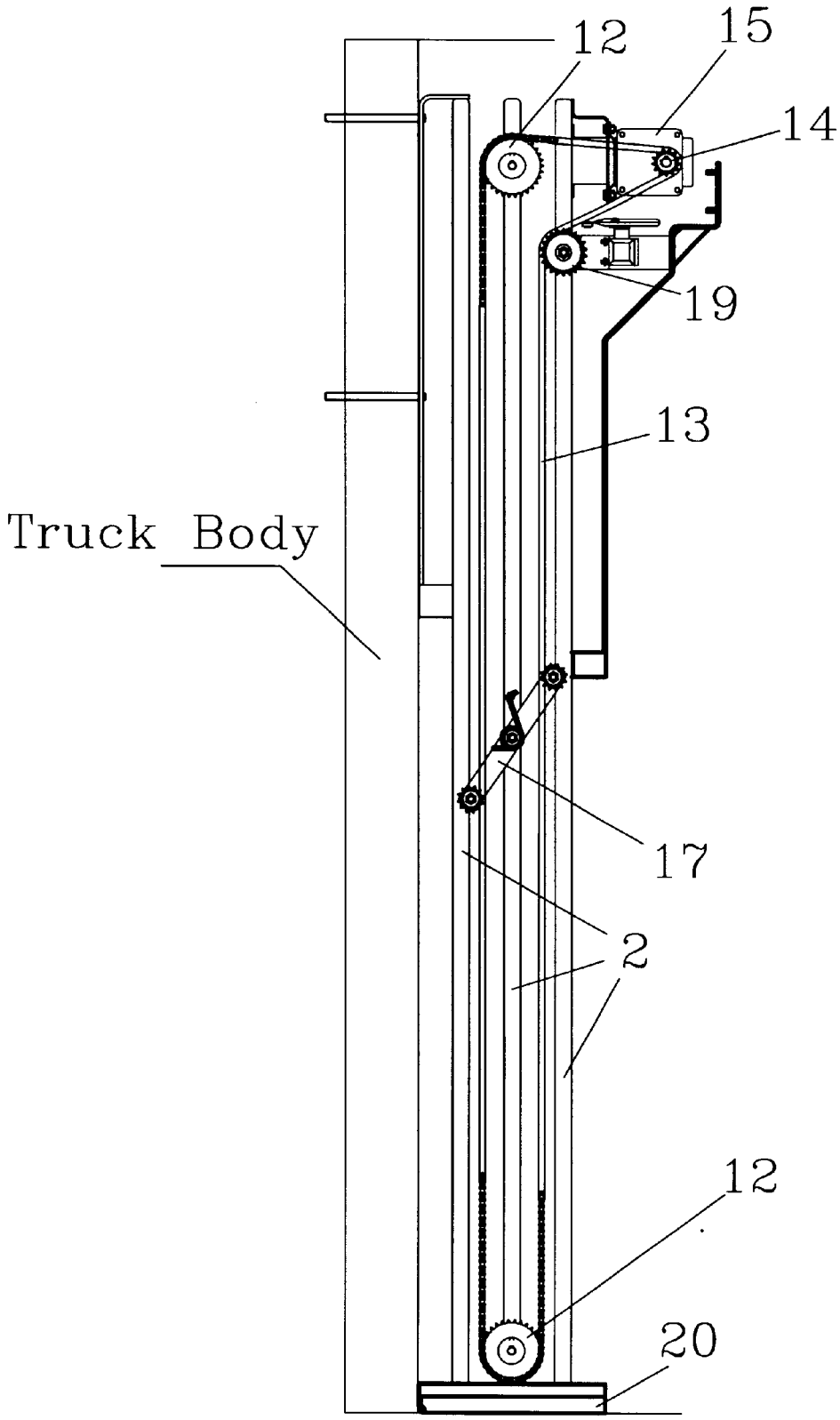
FIG. 9 represents a side view illustrating the scraper mechanism
Figure 10:
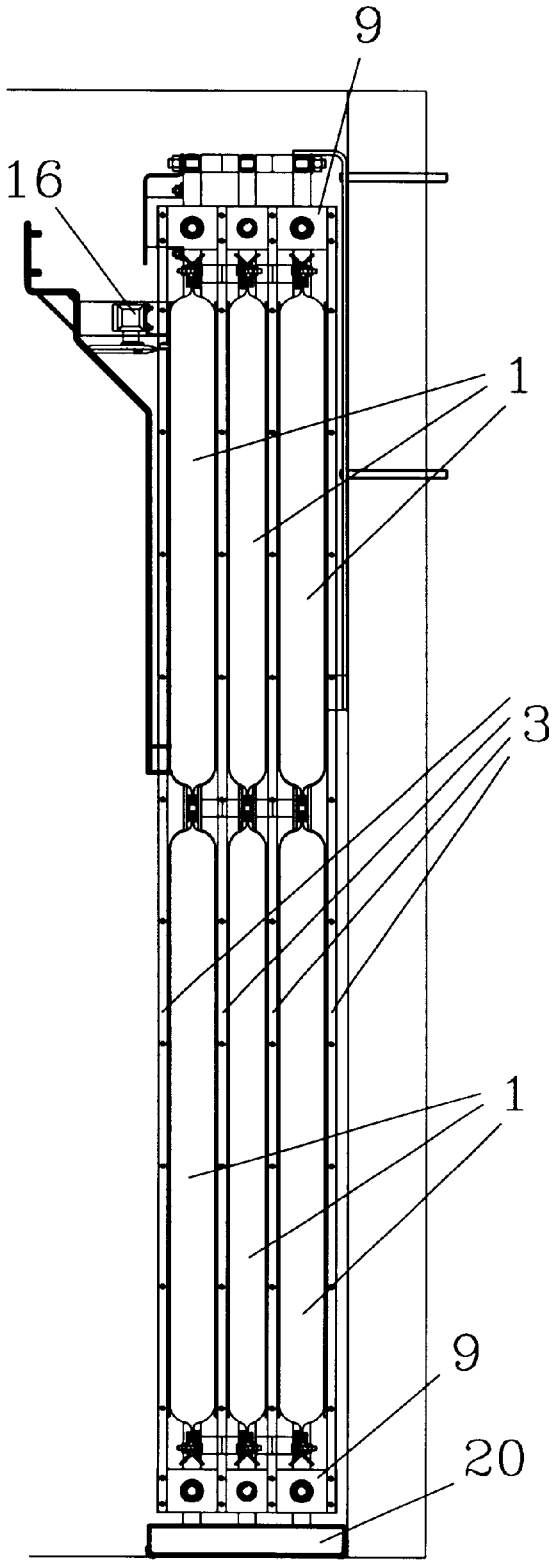
FIG. 10 represents an opposite side view of FIG. 9

In FIGS. 2 and 4, the upper extremities of the scrapers (3) are fastened to the upper scraper support (6). The lower extremities of the scrapers (3) are fastened to the lower scraper support (6) in the same fashion. Each support (6) moves along two tubular guide bars (7) which are parallel to the eutectic plates (1). Two guide bars. (7) are located above the eutectic plates (1) and two are located below. FIG. 5 shows that the extremities of these four guide bars (7) are fastened to guide bar supports (9). Linear bearings (8) ensure that the movement of the guide bars (7) is smooth. To ensure that the upper and lower supports (6) move at the same speed, FIG. 8 shows that an endless screw (10) is installed parallel to and centered between the two upper guide bars (7) and that a second endless screw (10) is installed parallel to and centered between the two lower guide bars (7). A nut (18) is mounted on each scraper support (6), between the two linear bearings (8). The endless screw (10) is inserted in the nut (18). In order to simplify FIGS. 1, 2, 4, 5 and 6, only one of the two upper guide bars (7) is illustrated and the lower bars are not illustrated at all. On the other hand, the lower endless screw (10) is illustrated, whereas the upper one is not. The two upper guide bars (7) are superposed to the upper endless screw (10) according to the top view illustrated in FIGS. 1, 2, 4, 5 and 6. This also applies to the two lower guide bars (7) and the lower endless screw (10). FIG. 6 shows that a pinion (12) is mounted at one end of each endless screw (10). The endless screws (10) are supported by ball bearings (11) which are inserted in the tubular guide bar and endless screw supports (9). FIG. 9 shows that the pinion (12) for the upper endless screw (10) is linked to the pinion (12) of the lower endless screw (10) by a chain (13). A motor (15) with a pinion (14) drives the chain (13) and causes the two endless screws (10) to turn at the same speed. A chain adjuster (17) ensures that the chain remains taut. A diverting sprocket-wheel (19) allows the motor (15) to be mounted outside of the plane formed by the upper and lower endless screws (10). Limit switches (16) are installed to invert the rotation of the motor and to cause the scrapers to sweep in the opposite direction.

This defrosting system can be used in other systems where frost is formed and where the surfaces to be defrosted are flat, cylindrical or revolution surfaces. In such a case, the scrapers would turn around the axis of revolution of the surface and would be in contact with the said surface. The surfaces must be kept at a sufficiently low temperature so that the density of the frost remains low and to ensure the adequate performance of the scrapers.

The embodiments of the invention in which an exclusive property or privilege is claimed are defined as follows:

1. In a refrigerated vehicle having a plurality of spaced eutectic plates, the improvement comprising scraper means arranged to scrape a surface of said eutectic plates, said scraper means comprising a scraper assembly, means for reciprocably moving said scraper assembly, said scraper assembly having at least one scraper blade secured thereto, said scraper blade being secured by means of a flexible portion.

2. The improvement of claim 1 further including guide means located proximate said one surface of said eutectic plates, said scraper assembly being guided by said guide means during reciprocable movement thereof.

3. The improvement of claim 2 wherein said guide means comprise a pair of parallel guide bars extending adjacent said one surface of said eutectic plates.

4. The improvement of claim 1 wherein said drive means comprises an electric motor driving an endless screw.

5. The improvement of claim 4 wherein said electric motor is connected to said endless screw by means of a chain drive.

6. The improvement of claim 1 wherein there are provided at least a pair of eutectic plates having facing surfaces, said scraper assembly having scraping blades operative to scrape both of said facing surfaces of said eutectic plates.

7. The improvement of claim 1 further including a container for collecting frost removed from said eutectic plates.

* * * * *